US009907994B1

(12) United States Patent
Maresh

(10) Patent No.: US 9,907,994 B1
(45) Date of Patent: Mar. 6, 2018

(54) TREADMILL WITH FOLDING OVERHEAD HANDLEBAR ASSEMBLY

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 15/334,268

(22) Filed: Oct. 25, 2016

Related U.S. Application Data

(63) Continuation-in-part of application No. 14/588,901, filed on Jan. 2, 2015, now Pat. No. 9,474,928.

(60) Provisional application No. 61/964,363, filed on Jan. 2, 2014.

(51) Int. Cl.
*A63B 22/02* (2006.01)
*A63B 21/00* (2006.01)

(52) U.S. Cl.
CPC ..... *A63B 21/4035* (2015.10); *A63B 22/0235* (2013.01)

(58) Field of Classification Search
CPC ..... A63B 21/4035; A63B 22/00; A63B 22/02; A63B 22/0235; A63B 22/0242; A63B 22/0207; A63B 22/0214; A63B 22/0221; A63B 22/0228
USPC ..... 482/51–54, 57–65
See application file for complete search history.

(56) References Cited

U.S. PATENT DOCUMENTS 4,114,873 A * 9/1978 Jones ..... A63B 69/0022 482/139
RE31,465 E * 12/1983 Robichaud ..... E04H 15/06 135/133
4,425,929 A * 1/1984 Von Mosshaim ..... E04H 15/56 135/116
5,171,196 A * 12/1992 Lynch ..... A63B 21/154 482/54
5,207,622 A * 5/1993 Wilkinson ..... A63B 22/0012 482/118
5,277,684 A * 1/1994 Harris ..... A63B 21/4047 482/121
5,374,225 A * 12/1994 Wilkinson ..... A63B 5/11 482/114
6,132,343 A * 10/2000 Eze ..... A63B 21/0615 482/97
6,494,814 B1 * 12/2002 Wang ..... A63B 22/02 482/51
6,565,494 B1 * 5/2003 Chen ..... A63B 21/0004 482/105
6,676,569 B1 * 1/2004 Radow ..... A63B 22/0235 482/4
6,719,665 B1 * 4/2004 Lai ..... A63B 23/03575 482/52
7,179,205 B2 * 2/2007 Schmidt ..... A63B 21/0058 482/51

(Continued)

*Primary Examiner* — Stephen R Crow
*Assistant Examiner* — Garrett Atkinson
(74) *Attorney, Agent, or Firm* — Nick A Nichols, Jr.

(57) ABSTRACT

A treadmill exercise machine may include a frame having a base and upright supports extending upward from a base. A handlebar assembly may be rotatably connected proximate the distal ends of the upright supports. The handlebar assembly may be moved from a non-deployed position to an upright locked position accessible to a user to grasp and pull down on an overhead hand bar of the handlebar assembly to reduce the weight load transmitted to the user's lower body.

5 Claims, 2 Drawing Sheets

(56) References Cited

U.S. PATENT DOCUMENTS

| | | | | |
|---|---|---|---|---|
| 7,291,096 | B2 * | 11/2007 | Ho | A63B 21/0084 482/53 |
| 7,494,450 | B2 * | 2/2009 | Solomon | A61H 1/0229 482/51 |
| 7,794,361 | B2 * | 9/2010 | Wang | A63B 21/15 482/51 |
| 7,878,950 | B1 * | 2/2011 | Bastian | A63B 22/0235 482/139 |
| 7,951,048 | B1 * | 5/2011 | Hsiung | A63B 22/001 482/52 |
| 7,985,166 | B2 * | 7/2011 | Farnsworth | A63B 23/1209 482/51 |
| 2004/0214693 | A1 * | 10/2004 | Piaget | A63B 22/0056 482/52 |
| 2006/0293153 | A1 * | 12/2006 | Porth | A63B 22/001 482/52 |
| 2007/0015634 | A1 * | 1/2007 | Ho | A63B 21/0084 482/54 |
| 2008/0176717 | A1 * | 7/2008 | Wang | A63B 22/0235 482/54 |
| 2009/0111666 | A1 * | 4/2009 | Wang | A63B 22/0235 482/54 |
| 2009/0253559 | A1 * | 10/2009 | Maresh | A63B 21/00072 482/93 |
| 2010/0144496 | A1 * | 6/2010 | Schmidt | A63B 21/012 482/70 |
| 2011/0082011 | A1 * | 4/2011 | Ellis | A63B 21/0615 482/54 |
| 2011/0281692 | A1 * | 11/2011 | Maresh | A63B 21/00072 482/54 |
| 2014/0038792 | A1 * | 2/2014 | Farnsworth | A63B 22/0012 482/112 |
| 2014/0066261 | A1 * | 3/2014 | Wang | A63B 22/0064 482/52 |

* cited by examiner

TREADMILL WITH FOLDING OVERHEAD HANDLEBAR ASSEMBLY

CROSS-REFERENCE TO RELATED APPLICATION

This is a continuation-in-part application of U.S. application Ser. No. 14/588,901, filed Jan. 2, 2015, now U.S. Pat. No. 9,474,928, which claims the benefit of U.S. Provisional Application Ser. No. 61/964,363, filed Jan. 2, 2014, which applications are incorporated herein by reference.

BACKGROUND

The present invention relates to exercise apparatus, and more particularly to a treadmill exercise machine including a movable overhead handlebar assembly that may be grasped while running and/or jogging on the treadmill.

Treadmill exercise machines for obtaining aerobic level exercise are well known. Treadmill machines may be by powdered by electric motors or by a user walking, jogging or running on the treadmill endless belt. Treadmill machines are widely used for aerobic conditioning and may be a component of a typical exercise regimen. However, an exerciser may avoid using a treadmill machine when experiencing pain from leg and/or foot injuries, back injuries or back pain from any one of numerous causes. Various exercise machines are available in the prior to exercise specific muscles and/or muscle groups or to perform specific exercises to strengthen a body component, such as the upper torso, or to perfect an athletic motion or technique, such a as proper golf swing. However, there remains a need to for an exercise machine that may be used to maintain one's physical conditioning while injured, particularly when physical mobility may be limited to walking or jogging.

SUMMARY

A treadmill exercise machine may include a frame having a base and upright supports extending upward from the base. A handlebar assembly may be rotatably connected to the upright supports. The handlebar assembly may include biasing members applying a biasing force to a hand grip bar of the handlebar assembly. The handlebar assembly may be moved from a non-deployed position to an upright locked position accessible to a user to grasp and pull down on the overhead hand grip bar of the handlebar assembly while exercising.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
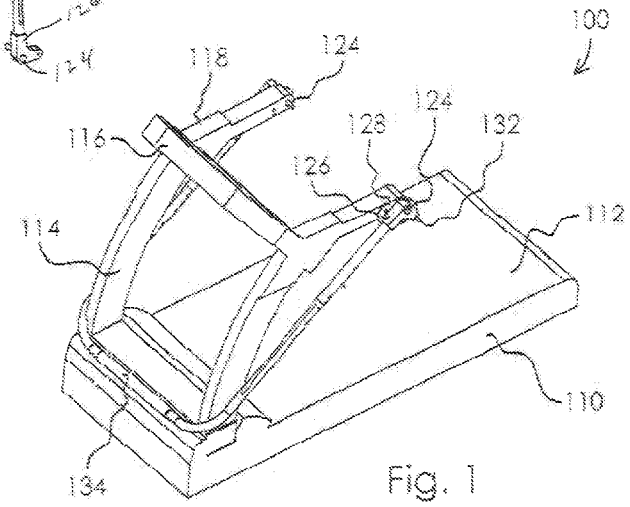
FIG. 1 is a perspective view of a treadmill exercise machine with a handlebar assembly in a parked position.

Referring first to FIG. 1, a treadmill exercise machine is generally identified by the reference numeral 100. The treadmill 100 may be of known construction and may include a base 110 supporting an endless belt 112 typically powered by an electric motor. A user may walk, jog and/or run on the endless belt 112. Upright stanchions 114 may extend upward from a front end of the base 110. The stanchions 114 may be spaced from one another and a cross bar connected between the stanchions 114 proximate an upper end thereof may support an interactive display 116 providing a user interface configured to perform a variety of functions, including displaying information to the user, such as available exercise parameters and/or programs and the like. Arms 118 may extend substantially horizontally from the upper ends of the stanchions 114. The arms 118 may be integrally formed with the stanchions 114 or fixedly connected thereto by welding or bolt connectors or other suitable means. The arms 116 may extend generally toward the rear of the treadmill base 110.

A handlebar assembly 120 may be pivotally connected to the arms 118 of the treadmill 100. The handlebar assembly 120 may include sleeve members 122 pivotally attached to a respective arm 118 at pivot shaft 124. An L-shaped or elbow connector 126 may be fixed to the lower ends of the sleeve members 122. The elbow connectors 126 may be integrally formed with the sleeve members 122 or may be separate components welded or otherwise fixedly connected to the sleeve members 122. The elbow connectors 126 may include a first hole extending therethrough proximate the juncture of the orthogonal legs forming the elbow connectors 126. The first hole of the elbow connectors 126 may be aligned with a hole extending through the treadmill arms 118 proximate the distal ends thereof for receiving the shaft 124 through the aligned holes and pivotally connecting the handlebar assembly 120 to the treadmill 100.

The arms 118 may include lobes 128 having a plurality of holes 130 that may be arranged on an arc concentric with the pivot shaft 124. A second hole extending through the elbow connectors 126 proximate the free distal end thereof may be selectively aligned with one of the holes 130 for inserting a pin 132 therethrough to releasably lock the handlebar assembly 120 in an upright deployed position relative to the treadmill arms 118.

The handlebar assembly may further include a U-shaped handlebar 133 comprising a transverse hand grip portion 134 and leg portions 136 extending from the respective ends thereof substantially orthogonal to the hand grip portion 134. The leg portions 136 may include a borehole for receipt of a pin 137 therethrough. The leg portions 136 may telescope relative to the sleeve members 122 so that the position of the hand grip portion 134 of the handlebar assembly 120 above the movable belt 122 may be adjusted to accommodate for differences in the height of users of the treadmill 100.

The sleeve members 122 may include longitudinal slots 123 on opposite sides of the sleeve members 122. The slots 123 are aligned and in spaced relationship to one another. In the illustrated embodiment, biasing members 125, such as but without limitation, a compression spring, may be compressed inside the sleeve members 122 by sliding the leg portions 136 of the handlebar 133 into the sleeve members 122. Accordingly, a compression force may be applied to the biasing members 125. Upon alignment of the boreholes in the leg portions 136 with the slots 123 in the sleeve members 122, the pin 137 may be inserted through the slots 123 and borehole of the leg portions 136. The biasing members 125 apply a biasing force to leg portions 136 to force the pin 137 into engagement with a stop shoulder provided by the distal ends of the slots 123 and thereby preventing separation or decoupling of the handlebar 133 from the sleeve members 122. In addition, the biasing members 125 may provide resistance for exercising the user's upper body.

Figure 3:
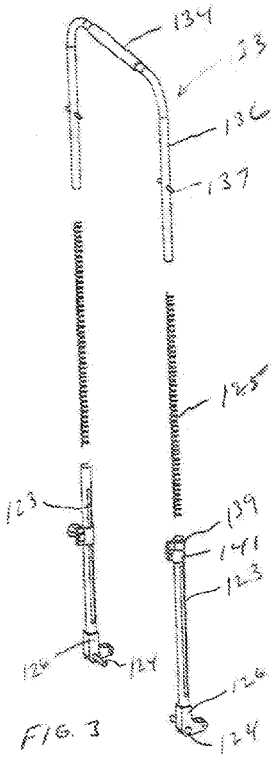
FIG. 3 is an exploded perspective view of the handlebar assembly of the treadmill exercise machine shown in FIG. 1.
Figure 2:
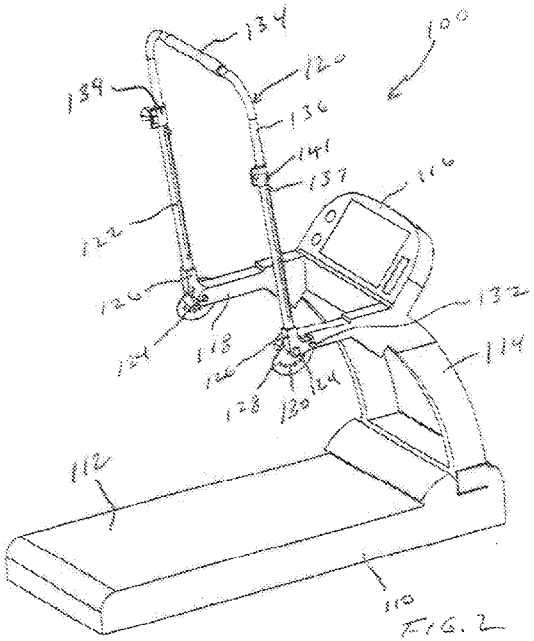
FIG. 2 is a perspective view of the treadmill exercise machine shown in FIG. 1 with the handlebar assembly in a deployed position.

The height of the hand grip portion 134 of the handlebar 133 above the belt 112 may be adjusted by re-positioning adjustment clamps 139 along the sleeve members 122. In FIG. 2 the clamps 139 are depicted clamped to the sleeve members 122 above the terminal ends of the slots 123. In this configuration, the highest point of the hand grip 134 above the belt 122 is defined by engagement of the stop pins 137 with the stop shoulders at the upper ends of the slots 123. The height of the hand grip 134 may be adjusted to accommodate the different heights of users by pulling downward on the hand grip 134 and compressing the biasing members 125. Upon positioning the hand grip 134 at the appropriate height, the clamps 139 may be lowered to the desired position and the knob 141 tightened to secure the clamps 139 on the sleeve members 122, as illustrated on one of the sleeve members 122 in FIG. 3.

When the handlebar assembly 120 is not deployed for use, the pins 132 may be removed from the holes 130 in the lobes 128 to permit the handlebar assembly 120 to be rotated about the shaft 124 to a storage or parked position generally in front of and below the display 116.

A user may operate the treadmill 100 by first rotating the handlebar assembly 120 from its parked position to an upright position so that the hand grip portion 134 is located above a user standing on the treadmill belt 112. When a user begins to exercise, he may grasp the hand grip portion 134 of the handlebar assembly 120 and pull downward to reduce the weight bearing load on the user's lower body. The reduction in the weight bearing load is proportional to the weight load transferred to the user's arms while he is pulling down on the handlebar assembly 120. The weight load reduction may not be limited solely to the user's legs and/or feet but may also affect the weight load on a user's spine resulting in a reduction in back pain while the user is exercising.

While pulling down on the handlebar assembly 120, a user may operate the treadmill 100 at higher speeds and thereby enable higher blood circulation while reducing the weight load on the user's spine and the user's legs and/or feet. The overhead hand grip 134 may provide a user with a longitudinal and lateral sense of the user's position on the endless belt 112 thereby providing an enhanced sense of security operating the treadmill 100, particularly for visually impaired users.

Figure 4:
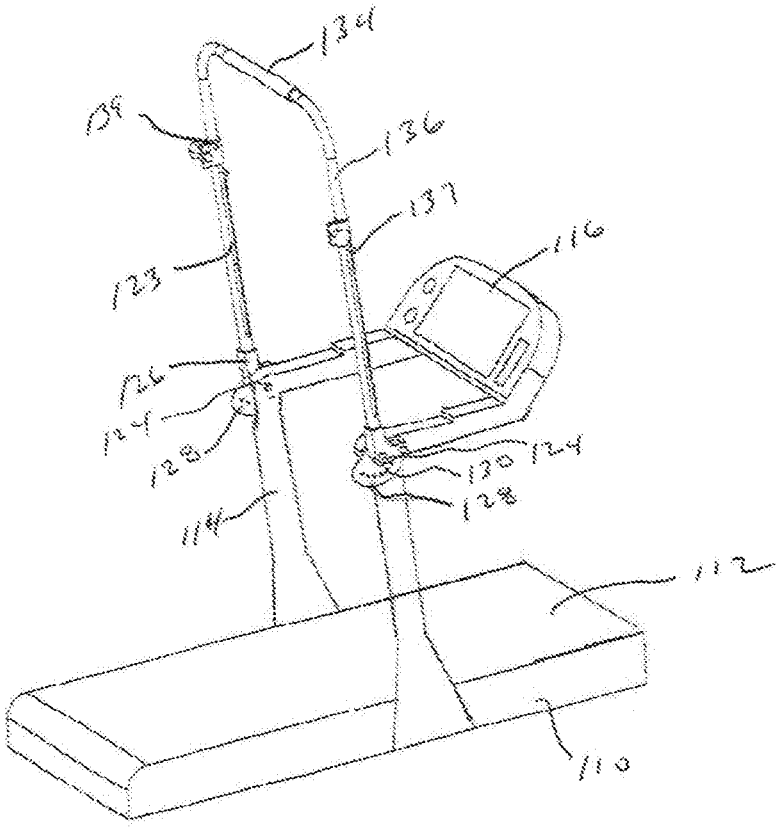
FIG. 4 is a perspective view of an alternate embodiment of a treadmill exercise machine with the handlebar assembly in a deployed position.

Referring first to FIG. 4, an alternate embodiment of a treadmill exercise machine is generally identified by the reference numeral 200. As evidenced by use of common reference numerals, the treadmill 200 is similar to treadmill 100 with the exception that the handlebar assembly 120 is pivotally connected to the stanchions 114. The stanchions 114 may extend upward from the base 110. The stanchions 114 may be spaced from one another defining a gap therebetween. Arms 118 may extend substantially horizontally from the upper ends of the stanchions 114. The arms 118 may be integrally formed with the stanchions 114 or fixedly connected thereto by welding or bolt connectors or other suitable means. The arms 116 may extend generally toward the forward end of the treadmill base 110. A cross bar connected between the arms 118 proximate a distal end thereof may support an interactive display 116 providing a user interface configured to perform a variety of functions, including displaying information to the user, such as available exercise parameters and/or programs and the like.

Operation of the treadmill 200 is substantially similar to operation of the treadmill 100 described above. The handlebar assembly 120 may first be rotated to an upright position so that the hand grip portion 134 is located above a user standing on the treadmill belt 112 between the stanchions 114. As described above with reference to treadmill 100, when the user begins to exercise, he may grasp the hand grip portion 134 of the handlebar assembly 120 and pull downward to reduce the weight bearing load on the user's lower body. The reduction in the weight bearing load is proportional to the weight load transferred to the user's arms while he is pulling down on the handlebar assembly 120. The weight load reduction may not be limited solely to the user's legs and/or feet but may also affect the weight load on a user's spine resulting in a reduction in back pain while the user is exercising.

While preferred embodiments of the invention have been shown and described, other and further embodiments of the invention may be devised without departing from the basic scope thereof, and the scope thereof is determined by the claims which follow.

The invention claimed is:

1. A treadmill exercise apparatus, comprising:

a) a frame having a base configured to rest on a substantially flat surface;

b) a first stanchion and a second stanchion in spaced relationship to one another fixedly secured to said base;

c) a movable surface supported by said base; and d) a handlebar assembly rotatably connected to said frame proximate a distal end of said first and second stanchion, wherein said handlebar assembly is movable between a stored position to a deployed position overhead a user standing on said movable surface; and e) said handlebar assembly including a first sleeve member and a second sleeve member pivotally connected to a respective said first and second stanchion, and a handlebar having a transverse hand grip portion, a first leg member and a second leg member in telescoping relationship with a respective said first and said second sleeve member;

f) each said first and second sleeve member housing a biasing member that exerts a force on a respective said first and second leg member of said handlebar; and g) wherein each said first and second stanchion include a lobe member having a plurality of holes configured in an arc concentric with a pivot shaft connecting a respective first and second sleeve member of said handlebar assembly to said frame.

2. The treadmill apparatus of claim 1 wherein said handlebar is vertically adjustable relative to said movable surface.

3. The treadmill apparatus of claim 1 wherein said biasing member comprises a compression spring applying a biasing force to a respective said first and second leg member of said handlebar.

4. The treadmill apparatus of claim 1 including a transverse stop pin extending through a respective said first and second leg member, and further including a pair of spaced apart longitudinal slots in said first and second sleeve members, wherein opposite distal ends of said stop pin extend into said longitudinal slots of a respective said first and second sleeve member.

5. The treadmill apparatus of claim 1 including a clamp secured to a respective said first and second sleeve member, wherein said clamp is selectively movable along a respective said first and second sleeve member from a first clamped position to a second clamped position.

* * * * *